US008873780B2

(12) United States Patent
Gerber

(10) Patent No.: US 8,873,780 B2
(45) Date of Patent: Oct. 28, 2014

(54) HEARING SYSTEM AND METHOD FOR OPERATING THE SAME

(75) Inventor: Andreas Gerber, Küsnacht (CH)

(73) Assignee: Phonak AG, Stafa (CH)

( * ) Notice: Subject to any disclaimer, the term of this patent is extended or adjusted under 35 U.S.C. 154(b) by 135 days.

(21) Appl. No.: 13/695,673

(22) PCT Filed: May 12, 2010

(86) PCT No.: PCT/EP2010/056551

§ 371 (c)(1),
(2), (4) Date: Dec. 14, 2012

(87) PCT Pub. No.: WO2010/089419

PCT Pub. Date: Aug. 12, 2010

(65) Prior Publication Data

US 2013/0108090 A1 May 2, 2013

(51) Int. Cl.
*H04R 25/00* (2006.01)

(52) U.S. Cl.
CPC ..... *H04R 25/50* (2013.01); *H04R 25/70* (2013.01)
USPC ..... 381/314; 381/312; 381/315; 700/94

(58) Field of Classification Search
USPC ..... 381/60, 312, 314, 315, 23.1; 700/94
See application file for complete search history.

(56) References Cited

U.S. PATENT DOCUMENTS

| | | | | |
|---|---|---|---|---|
| 7,974,716 | B2 * | 7/2011 | Schumaier | 700/94 |
| 2006/0198530 | A1 | 9/2006 | Fischer et al. | |
| 2007/0237346 | A1 | 10/2007 | Fichtl et al. | |
| 2008/0152176 | A1 * | 6/2008 | Heerlein et al. | 381/323 |
| 2009/0257608 | A1 * | 10/2009 | Chew et al. | 381/312 |
| 2010/0202637 | A1 * | 8/2010 | Cornelisse et al. | 381/314 |
| 2010/0220879 | A1 * | 9/2010 | Feilner et al. | 381/314 |

FOREIGN PATENT DOCUMENTS

| | | | |
|---|---|---|---|
| EP | 1670285 | A2 | 6/2006 |
| EP | 1919256 | A2 | 5/2008 |
| WO | 01/20965 | A2 | 3/2001 |
| WO | 01/22790 | A2 | 4/2001 |
| WO | 02/32208 | A2 | 4/2002 |
| WO | 2009/068028 | A1 | 6/2009 |

OTHER PUBLICATIONS

International Search Report for PCT/EP2010/056551 dated Jul. 16, 2010.
Written Opinion for PCT/EP2010/056551 dated Jul. 16, 2010.

* cited by examiner

*Primary Examiner* — Curtis Kuntz
*Assistant Examiner* — Joshua A Kaufman
(74) *Attorney, Agent, or Firm* — Pearne & Gordon LLP

(57) ABSTRACT

A method for operating a hearing system comprises the steps of: a) replacing the current settings by the former settings upon operation of a reset user control; and one of the steps of: b1) automatically replacing the former settings by new former settings upon receiving a request for adjusting at least one setting of the current settings, provided that no adjustment to the current settings has been carried out for at least a pre-defined time span up to the receiving of that request; or b2) automatically replacing the former settings by new former settings upon receiving a request for adjusting at least one setting of the current settings, provided that a difference between the current settings and the former settings caused by one or more adjustments to the current settings carried out during a pre-defined time span up to the receiving of that request is larger than a pre-defined difference.

16 Claims, 2 Drawing Sheets

HEARING SYSTEM AND METHOD FOR OPERATING THE SAME

TECHNICAL FIELD

The invention relates to the field of hearing devices. It relates to methods and apparatuses according to the opening clauses of the claims.

Under a hearing device, a device is understood, which is worn in or adjacent to an individual's ear with the object to improve the individual's audiological perception. Such improvement may also be barring acoustic signals from being perceived in the sense of hearing protection for the individual. If the hearing device is tailored so as to improve the perception of a hearing impaired individual towards hearing perception of a normal-hearing individual, then we speak of a hearing-aid device. With respect to the application area, a hearing device may be applied, e.g., behind the ear, in the ear, completely in the ear canal or may be implanted.

A hearing system comprises at least one hearing device. In case that a hearing system comprises at least one additional device, all devices of the hearing system are operationally connectable within the hearing system. Typically, said additional devices such as another hearing device, a remote control or a remote microphone, are meant to be worn or carried by said individual.

Under audio signals we understand electrical signals, analogue and/or digital, which represent sound.

BACKGROUND OF THE INVENTION

Today's programmable digital hearing device are usually programmed using a fitting system comprising a personal computer and a dedicated fitting system running on the computer. The programming is usually carried out by a hearing device professional such as an audiologist at his office. It is also possible to provide that the hearing device user carries out some or all of the programming of his hearing device. Considering the usually high number of programmable parameters, it is conceivable that it can happen that after adjusting a number of parameters, the so-achieved result is worse than what one had before. In such a case, it is desirable to be able to have access to parameter settings which produce a better hearing sensation than the current parameter settings.

In US 2008/0152176 A1, it is suggested to store a history of the most recent settings and to retrieve these in a step-by-step manner, e.g., by pressing and holding a button for corresponding number of times, which is practically like an undo function as known in standard computer software.

SUMMARY OF THE INVENTION

One object of the invention is to create an improved way of resetting a hearing device. A method for operating a hearing system shall be provided, which provides an improved way of resetting a hearing device. Therein, resetting means restoring former settings. In addition, the respective hearing system shall be provided.

Another object of the invention is to provide a particularly user-friendly way of resetting a hearing device.

Another object of the invention is to provide a particularly user-friendly way of programming a hearing device.

Another object of the invention is to provide a way of resetting a hearing device which requires only little storage space.

Further objects emerge from the description and embodiments below.

At least one of these objects is at least partially achieved by apparatuses and methods according to the patent claims.

The method is a method for operating a hearing system comprising a hearing device, a first and a second memory unit, an input converter, a signal processor controllable by sound processing parameters for processing audio signals obtained from said input converter, a user interface comprising a reset user control and one or more programming user controls, and a programming unit, wherein said signal processor is controlled by settings of sound processing parameters available in said first memory unit, referred to as current settings, and wherein said programming unit is structured and configured for adjusting said current settings as requested by operations of at least one of said one or more programming user controls, and wherein said first memory unit comprises said current settings, and said second memory unit comprises settings of sound processing parameters formerly available for controlling said signal processor, referred to as former settings. The method comprises the step of a) replacing said current settings in said first memory unit by said former settings upon operation of said reset user control;

and one of the steps of b1) automatically replacing said former settings in said second memory unit by new former settings upon receiving a request for adjusting at least one setting of said current settings from an operation of at least one of said one or more programming user controls, provided that no adjustment to said current settings as requested by an operation of at least one of said one or more programming user controls has been carried out for at least a pre-defined time span up to said receiving of said request; and b2) automatically replacing said former settings in said second memory unit by new former settings upon receiving a request for adjusting at least one setting of said current settings from an operation of at least one of said one or more programming user controls, provided that a difference between said current settings and said former settings caused by one or more adjustments to said current settings carried out during a pre-defined time span up to said receiving of said request is larger than a pre-defined difference.

Through this, it is possible to allow to reset a hearing system or more particularly a hearing device, in a way which needs only little memory space, which is relatively robust (in the sense that it is quite well ensured that the user can safely return to reasonable settings), and which is easy to understand and handle by a user of the hearing system and the hearing device, respectively. Within the hearing system, it is automatically determined, by when the new former settings have to be stored, wherein the preconditions (addressed in steps b1) and b2), respectively) are such that it can be ensured that only such sound processing parameter settings are stored in said second memory unit (to be possibly recalled later by resetting) which have proved apparently useful in the past, wherein this again is judged from the length of time during which the parameters were valid (unchanged).

In one embodiment, in case of step b1), said new former settings are identical with those current settings which were stored in said first memory unit at the time just before said receiving of said request, and, in case of step b2), said new former settings are identical with those current settings which were stored in said first memory unit at the time just before a first of said one or more adjustments to said settings of said current settings during said pre-defined time span has been carried out.

This way, such settings are stored in the second memory unit (to be recalled later by resetting), which were valid (i.e.

used as current settings) in an unchanged form (step b1)) or in an only slightly changed form (step b2)) during a sufficiently long time.

In another embodiment, in case of step b1), said new former settings are, for a portion of said sound processing parameters, identical with those current settings which were stored in said first memory unit at the time just before said receiving of said request, and for the rest of said sound processing parameters identical with said former settings in said second memory unit, and, in case of step b2), said new former settings are, for a portion of said sound processing parameters, identical with those current settings which were stored in said first memory unit at the time just before a first of said one or more adjustments to said settings of said current settings during said pre-defined time span has been carried out, and for the rest of said sound processing parameters identical with said former settings in said second memory unit.

This way, only such settings are newly stored in the second memory unit (to be recalled later by resetting), which were valid (i.e. used as current settings) during a sufficiently long time (in an unchanged or only slightly changed form), but not all of such long-time-valid settings are newly stored in the second memory unit; for some sound processing parameters, the settings in the second memory unit remain unchanged. Why this can be valuable becomes evident from the following two embodiments.

In one embodiment to be combined with the before-addressed embodiment, a selection as to which of said sound processing parameters belong to said portion of said sound processing parameters depends on a hearing program currently selected in said hearing system, more particularly in said hearing device. E.g., in the not uncommon case that a hearing program does not provide settings for all the sound processing parameters by means of which the signal processor can be controlled (but only for a portion of these), it would be possible to provide that those sound processing parameters which are not influenced by the hearing program remain unchanged in the second memory unit when storing new former settings in the second memory unit. Or, it is also possible to provide that only a subset of the settings of a hearing program contribute to the new former settings to be stored in the second memory unit.

The selection of said hearing program may be carried out manually by a user of said hearing system/of the hearing device. And it is alternatively or additionally possible to provide that the selection of said hearing program is carried out automatically by said hearing system/by said hearing device.

In an embodiment to be combined with the before-last addressed embodiment, the method comprises the step of classifying an acoustic environment of said hearing system (or more particularly of said hearing device), and a selection as to which of said sound processing parameters belong to said portion of said sound processing parameters depends on a result of said classification.

This way, the current acoustic environment is decisive for the determination of the settings to replace in the second memory unit and to leave unchanged, respectively. Considering that usually also the current settings (in the first memory unit) are chosen in dependence of the classification result, this embodiment is in some way similar to the before-addressed embodiment, but it is the classification result and therefore the current acoustic situation which determines the current settings.

Although classification (as it is understood in the present patent application) is well known in the field of hearing devices, it shall be pointed out that further details about classification can be found, e.g., in the following documents incorporated hereby in the present application in their respective entirety: WO 01/20965 A2, WO 01/22790 A2, WO 02/32208 A2 and EP 1 670 285 A2.

In one embodiment which may be combined with one or more of the before-addressed embodiments, said pre-defined time-span is an absolute time span. E.g., the pre-defined time-span a duration is between 12 hours or 48 hours, in particular between 18 hours and 36 hours, of absolute time.

In one embodiment which may be combined with one or more of the before-addressed embodiments except for the before-addressed embodiment, said pre-defined time-span is a span of on-time of the hearing device. This way, it is taken into account, e.g., that possibly, the hearing device is hardly used during one or more days, i.e. that a considerable absolute time span can pass without the hearing device user having the possibility to actually experience the current settings. Making said pre-defined time span dependent on the on-time of the hearing device is more suitable to ensure that only such settings are written into the second memory unit which actually proved to be suitable.

In one embodiment which may be combined with one or more of the before-addressed embodiments except for the two before-addressed embodiments, said pre-defined time-span is a time-span composed of an absolute time span and of a span of on-time of the hearing device.

In one embodiment which may be combined with one or more of the before-addressed embodiments, said pre-defined time span is measured within the hearing system; in particular, said pre-defined time span is measured within the hearing device. This makes the hearing system and the hearing device, respectively, autarkic, as it provides independence of external devices or appliances. It is also possible to determine the elapsing of said pre-defined time span externally to said hearing system. This can be particularly handy in case of absolute time spans; e.g., the absolute time can be received via the internet or by a radio-controlled clock.

In one embodiment which may be combined with one or more of the before-addressed embodiments, the method comprises, in case of step b2), the step of determining said difference between said current settings and said former settings. And said determining said difference comprises (or substantially is) summing up, for a multitude or for all of said sound processing parameters in a weighted or non-weighted manner, a difference between the respective current setting and the respective former setting. This way, an overall deviation of the current settings from the former settings is taken into account in deciding whether or not to replace the former settings in the second memory unit by new settings.

In one embodiment which may be combined with one or more of the before-addressed embodiments except for the before-addressed embodiment, the method comprises, in case of step b2), the step of comparing, individually for each of a multitude of said sound processing parameters or for each and every of said sound processing parameters, a difference between the respective current setting and the respective former setting to a respective pre-defined difference. This allows to whether or not it is advisable to store new former settings in dependence of a change in a single sound processing parameter or in dependence of changes in a selection of sound processing parameters. E.g., certain sound processing parameters may be neglected in the decision whether or not to store new former settings. It is possible to provide that a large deviation of current settings and former settings of only one or of more sound processing parameters can already be decisive for storing new former settings.

In one embodiment which may be combined with one or more of the before-addressed embodiments, the method comprises storing said former settings in said second memory unit by storing the respective settings. This is a straight-forward and relatively safe way. The settings themselves, i.e. the values assigned to the respective sound processing parameters, are stored.

In one embodiment which may be combined with one or more of the before-addressed embodiments except for the last-addressed one, the method comprises storing said former settings in second memory unit by storing differences between the respective former settings and the respective current settings. This is a more space-saving way. Only deviations are stored; of course, the respective settings themselves are readily obtained from the stored differences.

In one embodiment which may be combined with one or more of the before-addressed embodiments, said hearing device comprises said signal processor and said input converter.

In one embodiment which may be combined with one or more of the before-addressed embodiments, said hearing device comprises said user interface. It is convenient to have the user reset control integrated in the hearing device because resetting can be accomplished without the need to have one or more additional devices at hand.

In one embodiment which may be combined with one or more of the before-addressed embodiments except for the last-addressed one, said hearing system comprises a programming device comprising said reset user control and said one or more programming user controls. Said programming device is not identical with said hearing device. It is convenient to have the user reset control in a separate device because space is scarce in a hearing device, and user controls such as buttons and switches may have a more agreeable size integrated in a separate device.

The hearing system comprises a hearing device, a first and a second memory unit, an input converter, a signal processor controllable by sound processing parameters for processing audio signals obtained from said input converter, a user interface comprising a reset user control and one or more programming user controls, and a programming unit, wherein said signal processor is structured and configured to be controlled by settings of sound processing parameters available in said first memory unit, referred to as current settings, and wherein said programming unit is structured and configured for adjusting said current settings as requested by operations of at least one of said one or more programming user controls and for A) replacing said current settings in said first memory unit by settings of sound processing parameters available in said second memory unit, referred to as former settings, upon operation of said reset user control; and for B1) automatically replacing said former settings in said second memory unit by new former settings upon receiving a request for adjusting at least one setting of said current settings from an operation of at least one of said one or more programming user controls, provided that no adjustment to said first settings as requested by an operation of at least one of said one or more programming user controls has been carried out for at least a pre-defined time span up to said receiving of said request;

or for

B2) automatically replacing said former settings in said second memory unit by new former settings upon receiving a request for adjusting at least one setting of said current settings from an operation of at least one of said one or more programming user controls, provided that a difference between said current settings and said former settings caused by one or more adjustments to said current settings carried out during at least a pre-defined time span up to said receiving of said request is larger than a pre-defined difference.

In particular, said signal processor is structured and arranged for processing audio signals obtained from said input converter.

In one embodiment of the hearing system, the hearing system comprises a programming device comprising said reset user control and said one or more programming user controls.

The invention comprises hearing systems with features of corresponding methods according to the invention, and vice versa.

The advantages of the hearing systems correspond to the advantages of corresponding methods and vice versa.

Further embodiments and advantages emerge from the dependent claims and the figures.

BRIEF DESCRIPTION OF THE DRAWINGS

Below, the invention is described in more detail by means of examples and the included drawings. The figures shows.

The reference symbols used in the figure and their meaning are summarized in the list of reference symbols. The described embodiments are meant as examples and shall not confine the invention.

DETAILED DESCRIPTION OF THE INVENTION

Figure 1:
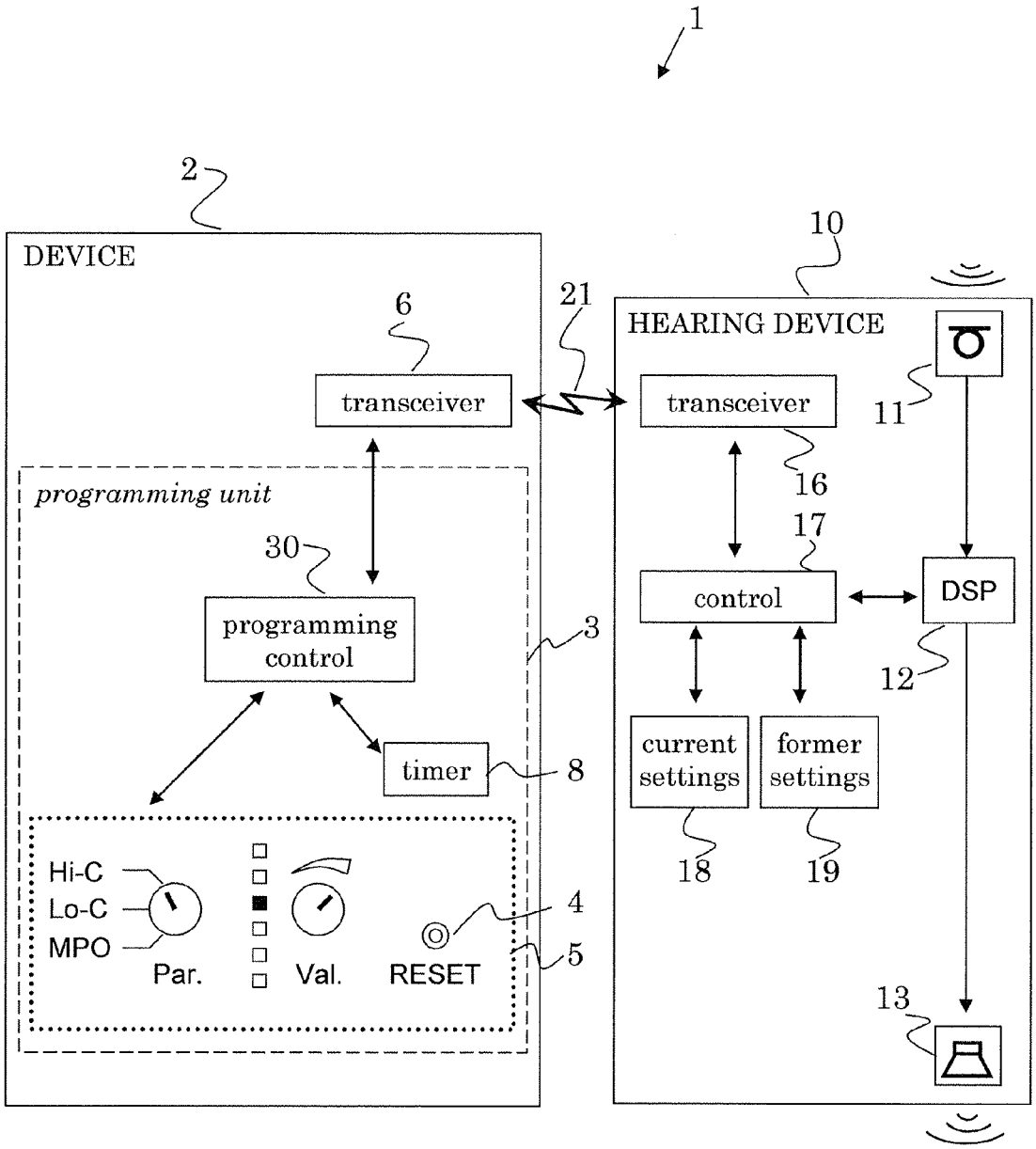
FIG. 1 a schematic diagram of a system.

FIG. 1 shows a schematic diagram of a system 1 comprising a device 2 and a hearing device 10 which are operationally interconnected. Device 2 can be used for programming hearing device 10 and for resetting sound processing parameters used in hearing device 10. Device 2 can be a remote control for hearing device 10.

The principal operation of hearing device 10 is sketched in the right part of hearing device 10 in FIG. 1: Hearing device 10 comprises an input transducer 11 such as a microphone, which produces audio signals from incoming acoustic sound, which are processed in a signal processor 12 (digital signal processor), and the so-processed audio signals are converted into signals to be perceived by the hearing device user in output transducer 13 such as a loudspeaker producing acoustic sound waves.

Device 2 is a handheld device to be operated by a hearing device user on his own. Its features are intentionally very limited so as to be easily understandable and usable, and it is robustly designed, with no pixel-based graphic user interface (such as an LED display). Most importantly, device 2 comprises a programming unit 3.

User interface 5 (indicated in FIG. 1 by the dotted rectangle) comprises one rotary knob by means of which a parameter to be adjusted can be selected ("Par." in FIG. 1), e.g., a parameter influencing the suppression of high frequencies can be selected ("Hi-C" in FIG. 1), a parameter influencing the suppression of low frequencies can be selected ("Lo-C" in FIG. 1), and a parameter influencing the maximum outputted sound level can be selected ("MPO" in FIG. 1). Of course more complex parameters could be provided (alternatively or additionally), e.g., a parameter, composed of a multitude of rather "physical" parameters, for increasing the speech intelligibility or a parameter for achieving a more agreeable perception of the user's own voice.

Having selected one parameter in the described way, turning another rotary knob ("Val." in FIG. 1) allows to adjust its value, i.e. the setting of the selected parameter. A row of LEDs gives a rough indication of the current parameter setting or at least of whether the value of the selected parameter is increased or decreased.

User interface 5 comprises another user control 4, namely a switch for resetting parameter values (of sound processing parameters) to former settings, which is useful if the hearing device user made adjustments he afterwards is not content with anymore, not knowing anymore how to reproduce better parameter settings. Operating that user control 4 will reset some or all hearing device parameters adjustable by means of the device 2. Details of the resetting will be discussed further below.

In order to accomplish that the parameter settings chosen by means of device 2 are used in hearing device 10, a communication link 21, in particular a wireless communication link (alternatively: a wire-bound link), is provided. A controller 30 of device 2 receives data representative of the hearing device user's manipulations of the user interface and generates corresponding digital data, and a transceiver 6 of device 2 transmits these digital data to a transceiver 16 of hearing device 10. A controller 17 controls the operation of signal processor 12 in dependence of the digital data received from device 2. Analogously, the user's demand to reset parameters (indicated by operating user control 4) is transmitted.

Preferably, increment/decrement data are transmitted to hearing device 10 upon turning the "Val." user control, such that parameter settings will be adjusted starting from the formerly valid setting.

The audio signal processing in signal processor 12 is controllable by sound processing parameters. Varying a value assigned to one such parameter (that value is also referred to as parameter setting or setting) can (and usually will) change the audio signal processing in signal processor 12. A memory unit 18 holds those settings which are currently used in signal processor 12; the corresponding set of parameter settings is also referred to as current settings.

If the user is not content with the sound outputted by hearing device 10, he will, in the above-described way by once or repeatedly selecting a parameter and a new setting using user interface 5, make changes to the current settings in memory unit 18, thus achieving (hopefully) improved hearing experience.

Accordingly, hearing device 10 can be programmed—in the sense of adjusting sound processing parameters—by means of device 2, namely by operating user controls of the user interface 5 of device 2 belonging to programming unit 3.

Particularly important is the possibility to reset settings of sound processing parameters using user control 4. For accomplishing a simple-to-handle, useful and safe resetting, a timer 8 and a memory unit 19 are provided. Timer 8 can also be contemplated external to programming unit 3, and memory unit 19 could be provided in device 2 instead of in hearing device 10. Memory unit 19 is preferably non-volatile memory.

Figure 2:
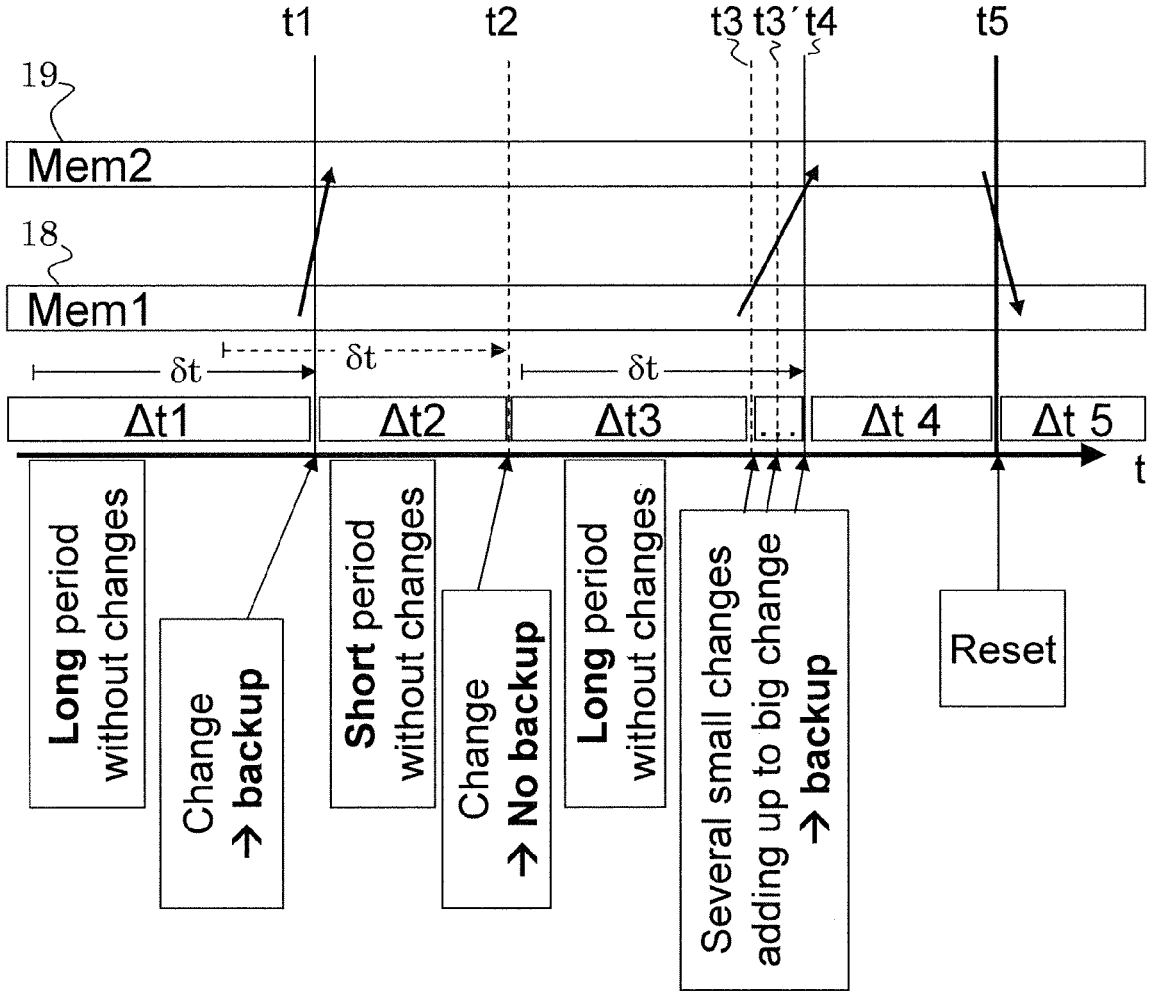
FIG. 2 an illustration of methods.

Further details of the resetting are described by means of FIG. 2, partially also referring to FIG. 1.

If the user operates user control 4 (in a suitable manner), former settings (settings which were valid at an earlier time) stored in memory unit 19 are recalled, i.e. are used as current settings then for which reason they are written into memory unit 18. This is symbolized in the right-hand part of FIG. 2 at time t5 ("Reset"), where data are copied from memory unit 19 into memory unit 18 as indicated by an arrow.

Note that there is only exactly one set of former settings recallable by operating user control 4. It could be provided that there are another one or more such former settings. An important question is, how the former settings come about; what qualifies former settings to become usable upon resetting; which data are written into memory unit 19?

Generally, only such settings shall be written into memory unit 19 which turned out to be useful, and this is judged from the time during which the settings have been used without being amended or used while having undergone only very little changes.

Therefore, as illustrated in the left part of FIG. 2, data (settings) are written from memory unit 18 (current settings) into memory unit 19 (former settings) as soon as a parameter adjustment ("Change") is requested, at time t1, at least if the requested parameter change is larger than a pre-defined change. And this happens only provided that in a pre-defined time-span δt before the request of the adjustment no (or no sufficiently large) adjustment has taken place. The settings written from the current settings to the former settings are of course settings valid before carrying out the requested parameter adjustment, as visualized by an arrow.

At time t2, another parameter adjustment is requested. But within δt before t2, an adjustment (in particular one that was sufficiently large) has already taken place. Therefore, no settings are written from the current settings to the former settings.

It is possible to provide that amendments having taken place during the pre-defined time-span δt have to sum-up to a certain pre-defined value before triggering the copying of data from memory unit 18 to memory unit 19. This is illustrated by the amendments at times t3, t3' and t4. Not before the third of these adjustments has been requested (at t4), the altogether parameter settings change is large enough to provoke the storing of new former settings. Settings written from memory unit 18 into memory unit 19 have been valid as current settings just before the first one of the amendments during δt has been requested, i.e. have been valid just before t3. Summing up changes in parameter settings preferably comprises weighting the respectively requested differences (setting deviations).

It is possible to write all current settings into memory unit 19 (provided that the before-addressed preconditions are met). But it is also possible to copy only a portion of these. Further details with respect to that have already been described in section "Summary of the Invention".

Timer 8 is used for determining whether the time-span δt has already elapsed. Further details with respect to that have already been described in section "Summary of the Invention".

It is to be noted that it is possible to implement reset user control 4 in hearing device 10. It is even possible to implement programming unit 3 in hearing device 10.

Aspects of the embodiments have been described in terms of functional units. As is readily understood, these functional units may be realized in virtually any number of hardware and/or software components adapted to performing the specified functions. For example, the memory units 18 and 19 can be realized in one and the same integrated circuit chip.

LIST OF REFERENCE SYMBOLS

1 system, hearing system
2 device
3 programming unit
4 user control, reset user control, reset control
5 user interface

6 transceiver
8 timer
10 hearing device, hearing-aid device
11 input transducer, mechanical-to-electrical transducer, microphone
12 signal processor
13 output transducer, electrical-to-mechanical transducer, loudspeaker
16 transceiver
17 controller, parameter controller
18 memory unit
19 memory unit
21 operational connection, communication link
30 controller, programming controller
t time
t1, t2, . . . time, point in time
δt pre-defined time span
Δt1, Δt2, . . . time span

The invention claimed is:

1. A method for operating a hearing system (1) comprising a hearing device (10), said hearing system (1) comprising a first (18) and a second memory unit (19), an input converter (11), a signal processor (12) controllable by sound processing parameters for processing audio signals obtained from said input converter (11), a user interface (5) comprising a reset user control (4) and one or more programming user controls, and a programming unit (3), wherein said signal processor (12) is controlled by settings of sound processing parameters available in said first memory unit (18), referred to as current settings, and wherein said programming unit (3) is structured and configured for adjusting said current settings as requested by operations of at least one of said one or more programming user controls, and wherein said first memory unit (18) comprises said current settings, and said second memory unit (19) comprises settings of sound processing parameters formerly available for controlling said signal processor (12), referred to as former settings, said method comprising the step of a) replacing said current settings in said first memory unit (18) by said former settings upon operation of said reset user control (4);

and one of the steps of b1) automatically replacing said former settings in said second memory unit (19) by new former settings upon receiving a request for adjusting at least one setting of said current settings from an operation of at least one of said one or more programming user controls, provided that no adjustment to said current settings as requested by an operation of at least one of said one or more programming user controls has been carried out for at least a pre-defined time span (δt) up to said receiving of said request; and b2) automatically replacing said former settings in said second memory unit (19) by new former settings upon receiving a request for adjusting at least one setting of said current settings from an operation of at least one of said one or more programming user controls, provided that a difference between said current settings and said former settings caused by one or more adjustments to said current settings carried out during a pre-defined time span (δt) up to said receiving of said request is larger than a pre-defined difference.

2. The method of claim 1, wherein, in case of step b1), said new former settings are identical with those current settings which were stored in said first memory unit (18) at the time just before said receiving of said request, and, in case of step b2), said new former settings are identical with those current settings which were stored in said first memory unit (18) at the time just before a first of said one or more adjustments to said settings of said current settings during said pre-defined time span (δt) has been carried out.

3. The method according to claim 2, wherein, in case of step b1), said new former settings are, for a portion of said sound processing parameters, identical with those current settings which were stored in said first memory unit (18) at the time just before said receiving of said request, and for the rest of said sound processing parameters identical with said former settings in said second memory unit (19), and, in case of step b2), said new former settings are, for a portion of said sound processing parameters, identical with those current settings which were stored in said first memory unit (18) at the time just before a first of said one or more adjustments to said settings of said current settings during said pre-defined time span (δt) has been carried out, and for the rest of said sound processing parameters identical with said former settings in said second memory unit (19).

4. The method according to claim 3, wherein a selection as to which of said sound processing parameters belong to said portion of said sound processing parameters depends on a hearing program currently selected in said hearing system (1).

5. The method according to claim 3, comprising the step of classifying an acoustic environment of said hearing system (1), and wherein a selection as to which of said sound processing parameters belong to said portion of said sound processing parameters depends on a result of said classification.

6. The method according to one of the preceding claims, wherein said pre-defined time span (δt) is an absolute time span or is a span of on-time of the hearing device (10) or is a time span composed of an absolute time span and of a span of on-time of the hearing device (10).

7. The method according to claim 1, wherein said pre-defined time span (δt) is measured within the hearing system (1).

8. The method according to claim 1, comprising, in case of step b2), the step of determining said difference between said current settings and said former settings, said determining said difference comprising summing up, for a multitude or for all of said sound processing parameters in a weighted or non-weighted manner, a difference between the respective current setting and the respective former setting.

9. The method according to claim 1, comprising, in case of step b2), the step of comparing, individually for each of a multitude of said sound processing parameters or for each and every of said sound processing parameters, a difference between the respective current setting and the respective former setting to a respective pre-defined difference.

10. The method according to claim 1, comprising storing said former settings in said second memory unit (19) by storing the respective settings.

11. The method according to claim 1, comprising storing said former settings in second memory unit (19) by storing differences between the respective former settings and the respective current settings.

12. The method according to claim 1, said hearing device (10) comprising said signal processor (12) and said input converter (11).

13. The method according to claim 1, said hearing device (10) comprising said user interface (5).

14. The method according to claim 1, said hearing system (1) comprising a programming device (2) comprising said reset user control (4) and said one or more programming user controls.

15. A hearing system (1) comprising a hearing device (10), a first (18) and a second memory unit (19), an input converter (11), a signal processor (12) controllable by sound processing parameters for processing audio signals obtained from said input converter (11), a user interface (5) comprising a reset user control (4) and one or more programming user controls, and a programming unit (3), wherein said signal processor (12) is structured and configured to be controlled by settings of sound processing parameters available in said first memory unit (18), referred to as current settings, and wherein said programming unit (3) is structured and configured for adjusting said current settings as requested by operations of at least one of said one or more programming user controls and for A) replacing said current settings in said first memory unit (18) by settings of sound processing parameters available in said second memory unit (19), referred to as former settings, upon operation of said reset user control (4); and one of the steps of B1) automatically replacing said former settings in said second memory unit (19) by new former settings upon receiving a request for adjusting at least one setting of said current settings from an operation of at least one of said one or more programming user controls, provided that no adjustment to said first settings as requested by an operation of at least one of said one or more programming user controls has been carried out for at least a pre-defined time span (δt) up to said receiving of said request; and B2) automatically replacing said former settings in said second memory unit (19) by new former settings upon receiving a request for adjusting at least one setting of said current settings from an operation of at least one of said one or more programming user controls, provided that a difference between said current settings and said former settings caused by one or more adjustments to said current settings carried out during at least a pre-defined time span (δt) up to said receiving of said request is larger than a pre-defined difference.

16. The hearing system (1) according to claim 15, comprising a programming device (2) comprising said reset user control (4) and said one or more programming user controls.

* * * * *